US006058921A

United States Patent [19]

Lawrence et al.

[11] Patent Number: 6,058,921

[45] Date of Patent: May 9, 2000

[54] PEEP SIGHT

[76] Inventors: David J. Lawrence, 749 Fieldstone Ter., St. Louis, Mo. 63119; Terry R. Whitford, 3424 Marquette, High Ridge, Mo. 63049

[21] Appl. No.: 09/067,794

[22] Filed: Apr. 28, 1998

[51] Int. Cl.[7] ..... F41B 5/00

[52] U.S. Cl. ..... 124/87

[58] Field of Search ..... 33/265; 124/87

[56] References Cited

U.S. PATENT DOCUMENTS

| | | | |
|---|---|---|---|
| 3,410,644 | 11/1968 | McLendon | 124/87 X |
| 4,011,853 | 3/1977 | Fletcher | 124/87 |
| 4,116,194 | 9/1978 | Topel | 124/87 |
| 4,552,121 | 11/1985 | Treaster | 124/87 |
| 4,656,747 | 4/1987 | Troncoso | 33/265 |
| 4,833,786 | 5/1989 | Shores | 33/265 |
| 5,056,498 | 10/1991 | Scherz | 124/87 |
| 5,148,603 | 9/1992 | Beutler | 33/265 |
| 5,157,839 | 10/1992 | Buetler | 33/265 |
| 5,325,598 | 7/1994 | Hall et al. | 33/265 |
| 5,669,146 | 9/1997 | Beutler | 33/265 |
| 5,697,357 | 12/1997 | Chipman | 124/87 |

*Primary Examiner*—John A. Ricci
*Attorney, Agent, or Firm*—Grace J. Fishel

[57] ABSTRACT

A peep sight having a body within which is mounted a transparent lens with a pair of substantially parallel faces and a peep hole for use on a weapon such as an archery bow or a firearm. The peep hole has a sidewall that slopes towards a target side of the lens and forms a contrast ring around the peep hole. The sidewall is preferably coated with a dark, non-reflective coating and the lens is colored for improved contrast.

14 Claims, 2 Drawing Sheets

PEEP SIGHT

BACKGROUND OF THE INVENTION

1. Field of the Invention

The present invention relates to a peep sight for spotting a target with increased accuracy even in low light.

2. Brief Description of the Prior Art

A peep sight is a form of aiming aid used on archery bows and on other weapons such as rifles, shotguns, pistols and the like. When a peep sight is used on an archery bow, it is mounted on a bowstring at a predetermined distance above a nocking point and has an aiming or peep hole so as to be in line of sight of the archer. The peep sight is typically affixed to the bowstring by separating strands of the bowstring and inserting them into external grooves or channels which are formed along the periphery of and in the central plane of the peep sight. As the bowstring is pulled back in anticipation of releasing an arrow, the archer sights the target by viewing it through the peep sight, optionally aided by a bow mounted front sight. The peep sight helps to ensure that the arrow can be consistently drawn back thereby improving accuracy.

Much hunting is done early in the morning or at sundown, under low light conditions, as that is when the animals leave their protective covering to feed. It is well known that a small diameter peep hole increases the accuracy of a peep sight. However, small diameter peep holes decrease the observed illumination of the target. In the case of archery peep sights, this problem has been addressed by illuminating the peep hole with electric lights or with light collected with phosphorescent paint. While illumination helps the archer to see the peep hole without making it larger, it also causes his or her pupils to contract, making the target more difficult to see. A better peep sight would allow a shooter to spot a target without increasing the size of the peep hole and without the addition of artificial lighting.

BRIEF SUMMARY OF THE INVENTION

In view of the above, it is an object of the present invention to provide a peep sight with a small diameter peep hole capable of spotting a target even under low light conditions. It is another object to provide a peep sight with excellent contrast. Other objects and features of the invention will be in part apparent and in part pointed out hereinafter.

A peep sight in accordance with the present invention has a body within which is mounted a lens of substantially transparent material, preferably photograde resin treated on both sides with an anti-reflective coating. Lens has a pair of substantially parallel faces, one of the faces being on a target side and the other of the faces being on a shooter's side. A peep hole is formed in the lens with a sidewall that slopes toward the target. The body is adapted to be mounted on a weapon so that the peep hole is in line of sight of the shooter when a shot is made with the sidewall providing a contrast ring around the peep hole.

When the weapon is an archery bow, the body has a pair of bowstring receiving channels for mounting the body on a bowstring so that the peep hole is in line of sight of the archer when the bowstring is in a drawn position and is angled with respect to a longitudinal extension of the bowstring when the bowstring is in an uncocked position. The sidewalls of the peep hole provide a contrast ring around the peep hole when the bowstring is in drawn position.

In a preferred embodiment, the sidewall is coated with a dark, non-reflective coating and the lens is yellow, providing better contrast with a target viewed through the peep hole. The lens is mounted in a lens barrel shielding it from stray light, minimizing image degradation. The inside of the lens barrel is also treated with as anti-reflective coating to protect against image degradation, as well as against the reflection of light into the eyes of the shooter where it would cause pupil contraction.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

DETAILED DESCRIPTION OF THE INVENTION

Figure 1:
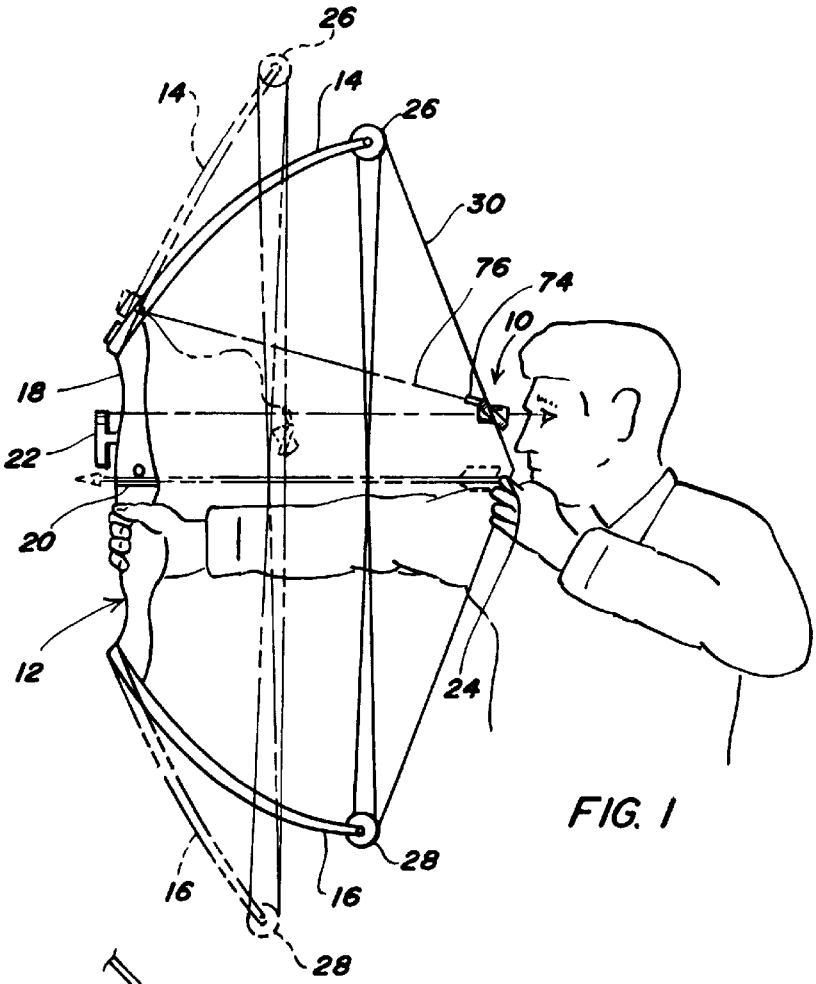
FIG. 1 a side elevational view of an archery peep sight in accordance with the present invention mounted on a conventional bow.

Referring to the drawings more particularly by reference character, reference numeral 10 refers to a peep sight in accordance with the present invention. Peep sight 10 may be used on any weapon such as an archery bow or firearm. A compound bow 12 is shown in FIG. 1 having upper and lower limbs 14, 16, respectively, a riser 18, an arrow rest 20, a front sight 22, a nocking point 24, upper and lower cams 26, 28, respectively, and a bowstring 30. Peep sight 10 is positioned on bowstring 30 above nocking point 24. Bow 12 is shown in full lines in its cocked state and in a relaxed condition in broken lines.

Figure 2:
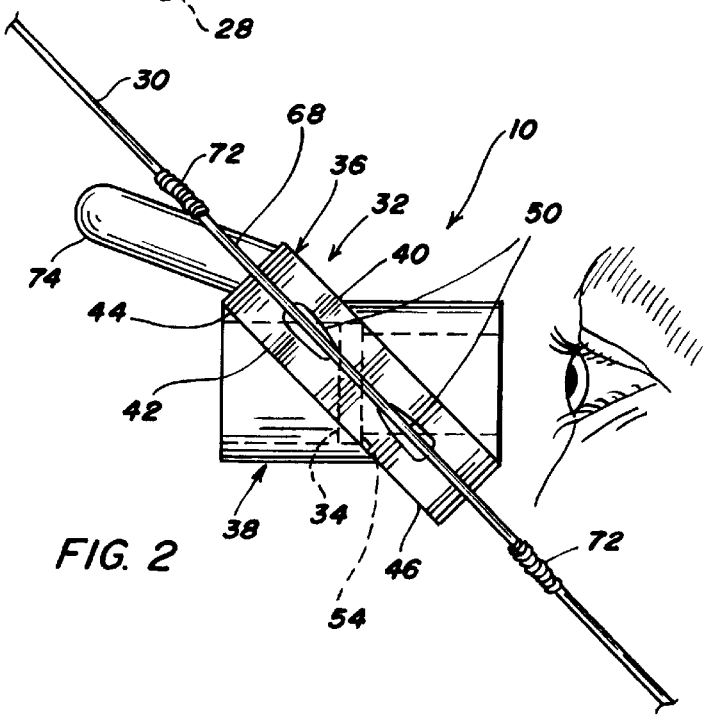
FIG. 2 is an enlarged side elevational view of the peep sight with the bowstring in cocked condition.
Figure 3:
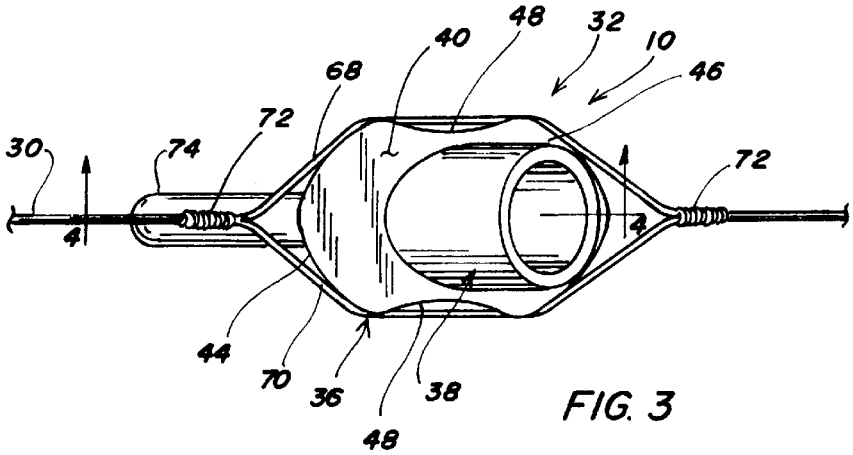
FIG. 3 is a plan view of the peep sight as viewed by the archer.
Figure 4:
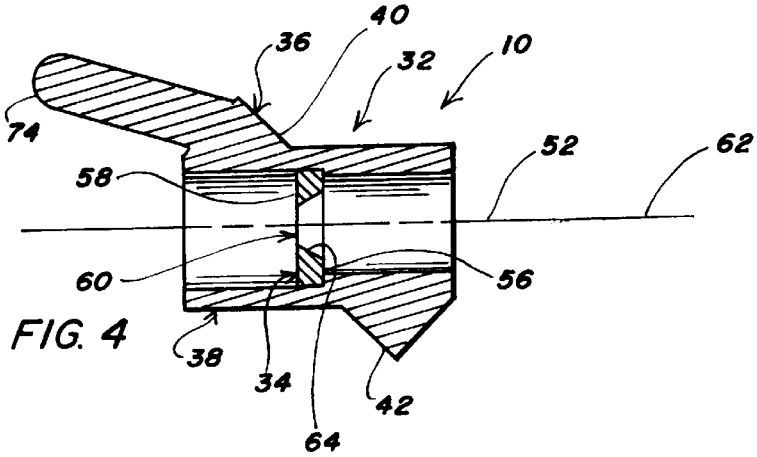
FIG. 4 is a cross-sectional view taken along line 4—4 in FIG. 3.
Figure 5:
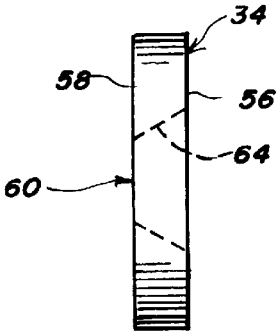
FIG. 5 is a side elevational view of the lens in the peep sight.

Turning now to FIGS. 2–4, peep sight 10 includes a body 32 within which is mounted a lens 34 formed of substantially transparent material, more particularly described below. Body 32 includes a planar base 36 through which a lens barrel 38 passes at an angle. As viewed by an archer in use, base 38 has front and back surfaces 40, 42, respectively, and upper and lower lobes 44, 46, respectively, connected by a necked down portion 48. Bowstring receiving channels 50 are formed along opposite sides of each lobe 44, 46 such that base 36 is longitudinally aligned with bowstring 30 in relaxed condition.

Lens barrel 38 has a longitudinal axis 52 and a compatible internal configuration for receipt and mounting of lens 34. The internal diameter of lens barrel 38 is greater on the target side than the shooter side, forming an annular abutment shoulder 54, against which lens 34 is press fitted, glued or otherwise attached. As shown in the drawings, lens barrel 38 is a cylinder with lens 34 mounted transverse axis 52 and generally midway the length of the cylinder, the lens barrel forming a hood protecting both sides of lens 34 from stray light.

Figure 6:
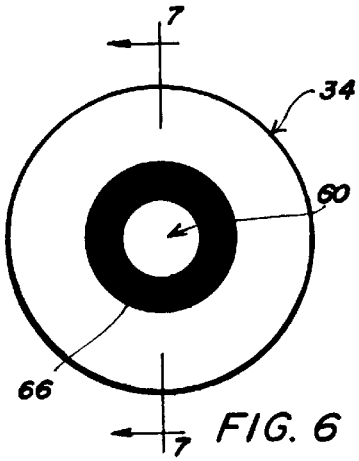
FIG. 6 is a plan view of the lens as viewed by the archer.
Figure 7:
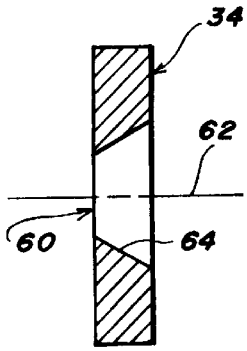
FIG. 7 is a cross-sectional view of the lens taken along line 7—7 in FIG. 6.

As shown in FIGS. 4–7, lens 34 has a pair of substantially parallel faces 56, 58, one of said faces 58 being on a target side and the other of said faces 56 being on a shooter side. As seen in FIG. 6, lens 34 is a circular disc but it can take other geometric forms. A hole 60 passes completely through lens 34 for use as a peep hole, said hole having a longitudinal axis 62. Axis 62 is perpendicular to parallel faces 56, 58 when the lens is not tilted in lens barrel 38 as shown in the drawings but will angled with respect to parallel faces 56, 58 when the lens is inclined. Hole 60 is illustrated in the drawings as a frustoconical surface whose top and base are substantially co-planar with faces 56, 58 and whose sidewall 64 is at about 60° to face 56. The slope of sidewall 64 may vary but is important that it meet faces 56, 58 to prevent image degradation. Sidewall 64 is made opaque to delineate it from the rest of lens 34 which is transparent so that when the peep hole is viewed from face 56 along longitudinal axis 62, sidewall 64 forms a contrast ring 66 around peep hole 60. For this purpose, it is preferred that a dark coating be applied to sidewall 64, most preferably a black non-reflective coating, and that the balance of lens 34 be colored (e.g., yellow). Although the preferred embodiment of the present invention utilizes faces 56, 58 in parallel orientation with respect to each other and hole 60 with a regularly sloped sidewall 64, the relationship between the planes of faces 56, 58 and the slope of sidewall 64 could be made less regular so long as the target can be seen through lens 34 and contrast ring 66 comes into view when peep hole 60 is viewed from face 56.

As best seen in FIG. 4, lens 34 is mounted in lens barrel 38 such that longitudinal axes 52, 62 are co-axial and lens barrel is at an angle to base 36. As shown, lens barrel makes about a 45° angle to base 36, which angle can be varied as needed with the length of the bow, etc. so that peep hole 60 becomes visible to the archer when bowstring 30 is cocked.

Bowstring 30 is typically formed of a plurality of strands which can be separated into divided portions 68, 70 having an equal or near equal number of filaments. Peep sight 10 is mounted by inserting it into the multi-strand bowstring at a position that will place peep hole 60 in line with the archer's eye when the bowstring is drawn and cocked. At the appropriate position of the bowstring, divided portions 68, 70 are inserted into channels 50 and peep sight 10 moved up or down for fine adjustment of positioning. When the final position is obtained, peep sight 10 is secured by servings 72 with waxed string or similar material above and below the peep sight. Alternatively, peep sight 10 may be secured with nock sets (not shown) or other devices. Because divided portions 68, 70 have an equal or near equal number of filaments, the compressive force on body 32 is nearly equal on both sides of upper and lower lobes 44, 46. The bowstring makes no contact with base 36 at necked down portion 48 where squeezing might give lens 34 an undesired aberration.

Body 32 is solid, opaque and preferably black. It can be formed by injection-molding a lightweight plastic material, such as polycarbonate, but other rigid or semi-rigid plastic or rubber materials may also be used, as can metals such as aluminum. The inside of lens barrel 38 is preferably treated with an anti-reflective black coating to minimize stray light reflections that might degrade the image viewed through lens 34.

Lens 34 is preferably formed of a transparent photograde resin and treated on both faces 56, 68 with several layers of an anti-reflective coating such as is typically applied to camera lenses. Lens 34 is preferably colored (e.g., yellow) to improve contrast in low light conditions. Peep hole 60 is small but not so small that ring 66 would appear closed.

Peep sight 10 can be made in different sizes. In a preferred embodiment, lens 34 is a disc having a diameter of 0.340 in. and a thickness of 0.062 in. with peep hole 60 having a diameter of 0.09 in. The base of ring 66 at face 56 has a diameter of 0.173 in. Lens barrel 38 has a length of 0.500 in. with an internal diameter of 0.300 in. on side 56 and 0.328 in. on side 58. Planar base 36 is 0.125 in. thick, 0.72 in. wide and 1.172 in. long. It will be understood that the above-mentioned dimensions are set forth by way of example for the purpose of fulfilling the disclosure requirements of the patent statute and not by way of limitation.

In use as illustrated in the drawings, peep sight 10 is positioned on bowstring 30 a distance above nocking point 24 so as to be in the line of sight of the archer. As bowstring 30 is cocked, peep sight 10 is pulled rearwardly and rotated away from the vertical plane of the bowstring. To compensate for this movement, lens barrel 38 with peep hole 60 is mounted at an angle to bowstring 30 in an uncocked position. When the bowstring is cocked, the archer aligns the center of peep hole 60 with a target, possibly together with a forward sight 22. Light from the target is funneled through peep sight 10 to lens 34. Peep hole 60 bounded by ring 66, is easily seen even in low light conditions, particularly when the balance of lens is colored. The colored lens also provides improved contrast with the target sighted in the peep hole. The quality of the image is protected from degradation by lens barrel 38 which excludes stray light from sources not in view through the peep sight. The anti-reflective coating on the inside of lens barrel and the anti-reflective coating on lens 34 also protect against image degradation, as well as against the reflection of light into the eyes of the archer where it would cause pupil contraction. Because of this combination of features, peep sight 10 allows the archer to spot a target accurately even under lower light conditions.

As bowstring 30 is cocked, peep sight 10 may have a tendency to rotate about the axis of the bowstring so that lens barrel 38 is misaligned with respect to the line of sight of the archer when the bow is cocked. To prevent this, a pin 74 may be formed on planar base 36 for attachment of one end of an elastic cord or tube 76, the opposite end of which is attached to riser 18. As bowstring 30 is drawn, elastic cord 76 stretches to exert a force upon body 32 to align lens barrel 38 and peep hole 60 with front sight 22 and the target.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A peep sight comprising a body within which is mounted a lens of substantially transparent material having a pair of substantially parallel faces, one of said faces being on a target side and the other of said faces being on a shooter side, said lens having a peep hole with a longitudinal axis, said body adapted to be mounted on a weapon so that the peep hole is in line of sight of a shooter, said peep hole having a sidewall that slopes toward the target, said sidewall providing a contrast ring around the peep hole when a shot is made.

2. The peep sight of claim 1 wherein the lens is formed of photograde resin and has an anti-reflective coating on both faces.

3. The peep sight of claim 2 wherein the lens is colored to increase contrast and the sidewall of the peep hole is covered with a dark, opaque coating.

4. An archery peep sight comprising a body with a planar base through which passes a lens barrel at angle to the base, said lens barrel having a longitudinal axis, a lens of substantially transparent material mounted transverse to the longitudinal axis of the lens barrel, said lens having a pair of substantially parallel faces, one of said faces being on a target side and the other of said faces being on an archer side, said lens having a peep hole with a longitudinal axis, said planar base including a pair of bowstring receiving channels for mounting the body on a bowstring so that the peep hole is in line of sight of an archer when a bowstring is in a drawn position and is angled with respect to a longitudinal extension of a bowstring when a bowstring is in an uncocked position, said peep hole having a sidewall that slopes toward the target, said sidewall providing a contrast ring around the peep hole when the bowstring is in a drawn position.

5. The peep sight of claim 4 wherein the lens is formed of photograde resin and has an anti-reflective coating on both faces.

6. The peep sight of claim 5 wherein the lens is colored to increase contrast and the sidewall of the peep hole is covered with a dark, opaque coating.

7. The peep sight of claim 6 wherein the inside of the lens barrel is covered with an anti-reflective coating.

8. The peep sight of claim 7 wherein a pin is provided on the base for attachment to an elastic cord that aligns the lens and peep hole with the line of sight of the archer as the bowstring is drawn.

9. An archery peep sight comprising a body with a planar base through which passes a lens barrel at angle to the base, said lens barrel having a longitudinal axis, a lens of substantially transparent material mounted transverse to the longitudinal axis of the lens barrel, said lens having a pair of substantially parallel faces, one of said faces being on a target side and the other of said faces being on an archer side, said lens having a peep hole with a longitudinal axis that is substantially perpendicular to the parallel faces, said planar base having back and front planar surfaces connected by a side surface with a pair of bowstring receiving channels for mounting the body on a bowstring so that the peep hole is in line of sight of an archer when a bowstring is in a drawn position and is angled with respect to a longitudinal extension of a bowstring when a bowstring is in an uncocked position, said peep hole having a sidewall formed as a frustoconical surface whose top and base are substantially co-planar with the parallel faces of the lens, said sidewall sloped towards the target and providing a contrast ring around the peep hole when the bowstring is in a drawn position.

10. The peep sight of claim 9 wherein the lens is formed of photograde resin and has an anti-reflective coating on both faces and the body is opaque.

11. The peep sight of claim 10 wherein the lens is colored to increase contrast and the sidewall of the peep hole is covered with a dark, opaque coating.

12. The peep sight of claim 11 wherein the inside of the lens barrel is covered with an anti-reflective coating and the lens is mounted substantially midway the length of lens barrel, said lens barrel forming a hood protecting both sides of the lens from stray light.

13. The peep sight of claim 11 wherein the back and front surfaces of the planar base are shaped as a pair of lobes connected by a necked down portion, said channels for receiving the bowstring being on opposite sides of the lobes and making no contact with the necked down portion to avoid putting stress on the lens.

14. The peep sight of claim 12 wherein a pin is provided on the base for attachment to an elastic cord that aligns the lens and peep hole with the line of sight of the archer as the bowstring is drawn.

* * * * *